US007594997B1

(12) United States Patent
Kazarian

(10) Patent No.: US 7,594,997 B1
(45) Date of Patent: Sep. 29, 2009

(54) PORTABLE SKIMMER, MOTOR AND PUMP PROTECTOR FOR A SWIMMING POOL OR HOT TUB

(75) Inventor: Kenneth B. Kazarian, Broken Arrow, OK (US)

(73) Assignee: Wimax, LLC, Broken Arrow, OK (US)

( * ) Notice: Subject to any disclaimer, the term of this patent is extended or adjusted under 35 U.S.C. 154(b) by 173 days.

(21) Appl. No.: 11/934,430

(22) Filed: Nov. 2, 2007

Related U.S. Application Data

(60) Provisional application No. 60/865,029, filed on Nov. 9, 2006.

(51) Int. Cl.
*E04H 4/14* (2006.01)

(52) U.S. Cl. ..... 210/167.19; 210/232; 210/470; 4/496

(58) Field of Classification Search ..... 210/167.1, 210/167.19, 232, 470, 471; 4/490, 496
See application file for complete search history.

(56) References Cited

U.S. PATENT DOCUMENTS 4,140,634 A 2/1979 Harry
4,332,683 A * 6/1982 Alt ..... 210/499
4,369,109 A * 1/1983 Edge ..... 210/167.19
5,277,801 A * 1/1994 Lundquist ..... 210/167.19
5,288,414 A * 2/1994 Mongiello ..... 210/776
5,935,450 A 8/1999 Benedict
6,214,217 B1 4/2001 Sliger, Jr.
6,817,041 B1 11/2004 Evans et al.
2005/0055898 A1 3/2005 Georgeff et al.

* cited by examiner

*Primary Examiner*—Fred Prince
(74) *Attorney, Agent, or Firm*—Head, Johnson & Kachigian, P.C.

(57) ABSTRACT

A portable skimmer, motor and pump protector for a swimming pool or a hot tub having a sidewall, an adjoining top deck, a skimmer in the sidewall, in fluid communication with the pool pump and motor. The protector includes a frame having a top portion resting against the top deck, an upright portion resting against the sidewall, wherein the frame surrounds the skimmer. A handle extends from the top frame portion. Removable netting surrounds the frame to permit passage of water but prevent passage of leaves and other debris into the skimmer.

18 Claims, 1 Drawing Sheet

PORTABLE SKIMMER, MOTOR AND PUMP PROTECTOR FOR A SWIMMING POOL OR HOT TUB

CROSS-REFERENCE TO RELATED APPLICATION

This application claims priority to U.S. Provisional Application No. 60/865,029, filed Nov. 9, 2006.

BACKGROUND OF THE INVENTION

1. Field of the Invention

The present invention is directed to a portable skimmer, motor and pump protector for a swimming pool or a hot tub to prevent passage of leaves or other debris into the skimmer in order to avoid clogging or decreased efficiency of the skimmer, pump or motor. In particular, the present invention is directed to a lightweight, easily installable and easily removable protector which protects the skimmer from being clogged.

2. Prior Art

Swimming pool and hot tub systems pump water in a continual cycle, from the pool or hot tub through filtering and optional treatment systems and then back to the pool or hot tub again. In this manner, the system keeps the water in the pool or hot tub relatively free of dirt, debris and bacteria.

Water flows from the swimming pool through a skimmer which is recessed in a sidewall of the pool at the water level. The skimmer typically includes a removable basket to prevent leaves and other floating debris from passing through the pumping and filter system. The skimmer removes floating debris as it floats by the skimmer opening. A flapper or weir allows debris to flow into the skimmer but prevents it from drifting back out. Debris is caught in the skimmer basket and the basket is periodically emptied. Excessive debris can clog the basket, resulting in ineffective skimming. If the skimmer continues to be clogged, the basket may be damaged. Additionally, water flow may be interrupted resulting in damage to the pump or motor.

The skimmer is connected by piping to a pump and motor which pulls water from the pool or hot tub and through the skimmer into a filter. Optional equipment includes chemical treatment equipment, such as a chlorinator or brominator, and heaters. The pool water is thereafter delivered back to the swimming pool through piping and return inlets.

In certain conditions, such as stormy weather, and in certain seasons, such as the fall, leaves in large quantities may fall into the pool. During these times, the skimmer basket must be emptied frequently to prevent the basket from being clogged. The skimmer baskets are often composed of thin plastic and may be broken by the weight of the leaves and debris and the force of water being pumped therethrough. Additionally, when the basket is clogged, the pumping and filter system is not working efficiently. Moreover, if the basket becomes excessively clogged, water will not pass and the pump and motor may run "dry", causing damage to the pump or motor.

Prior attempts have been made to protect the skimmer. For example, Boggs et al. (U.S. Pat. No. 7,052,602) discloses a flat guard which is attached to the skimmer intake. Other prior solutions either attach to the walls of the swimming pool or to the skimmer itself. The guard disclosed in the application by Georgeff et al. (U.S. application Ser. No. 10/660,961) attaches to the walls of the swimming pool with suction cups. Sliger, Jr. (U.S. Pat. No. 6,214,217) discloses a skimmer screen held in place by a mounting bracket attached to the side wall of the pool. Similarly, Harry (U.S. Pat. No. 4,140,634) discloses a shield that mounts on hooks or bolts attached to the pool wall. The screen of Benedict (U.S. Pat. No. 5,935,450) attaches via retention flanges extending within the intake opening. Likewise, Evans et al. (U.S. Pat. No. 6,817,041) discloses a guard that attaches by means of brackets configured to bear against opposite opposed walls of the skimmer intake.

Accordingly, it is a principal object and purpose of the present invention to provide a portable skimmer, motor and pump protector which may be installed and operated without fasteners to the pool or to the skimmer.

It is a further object and purpose of the present invention to provide a skimmer, motor and pump protector which is portable and may be easily installed and removed.

It is a further object and purpose of the present invention to provide a portable skimmer, motor and pump protector which prevents the skimmer basket from being clogged and damaging the basket.

It is a further object and purpose of the present invention to provide a portable skimmer, motor and pump protector which prevents the pump and motor from running dry and prevents damage to the pump or motor.

SUMMARY OF THE INVENTION

The present invention is directed to a portable skimmer, motor and pump protector for a swimming pool or hot tub. The protector includes a frame to support netting which permits water from the pool or hot tub to easily pass therethrough. The netting substantially surrounds the skimmer and its opening.

The protector includes a frame having a pair of semi-circular or arched portions which are spaced from and parallel to each other. The frame also includes a brace portion extending between the semi-circular portions. Additionally, the frame includes a top portion which extends between the semi-circular brace portions and rests on the top deck of the swimming pool when in use.

The frame also includes a pair of upright portions which are spaced from and parallel to each other. When in use, the upright portions rest against the sidewall of the pool. Finally, the protector may include a handle which extends from the top portion of the frame and may be weighted to assist in holding the protector in place.

DETAILED DESCRIPTION OF THE PREFERRED EMBODIMENTS

Figure 1:
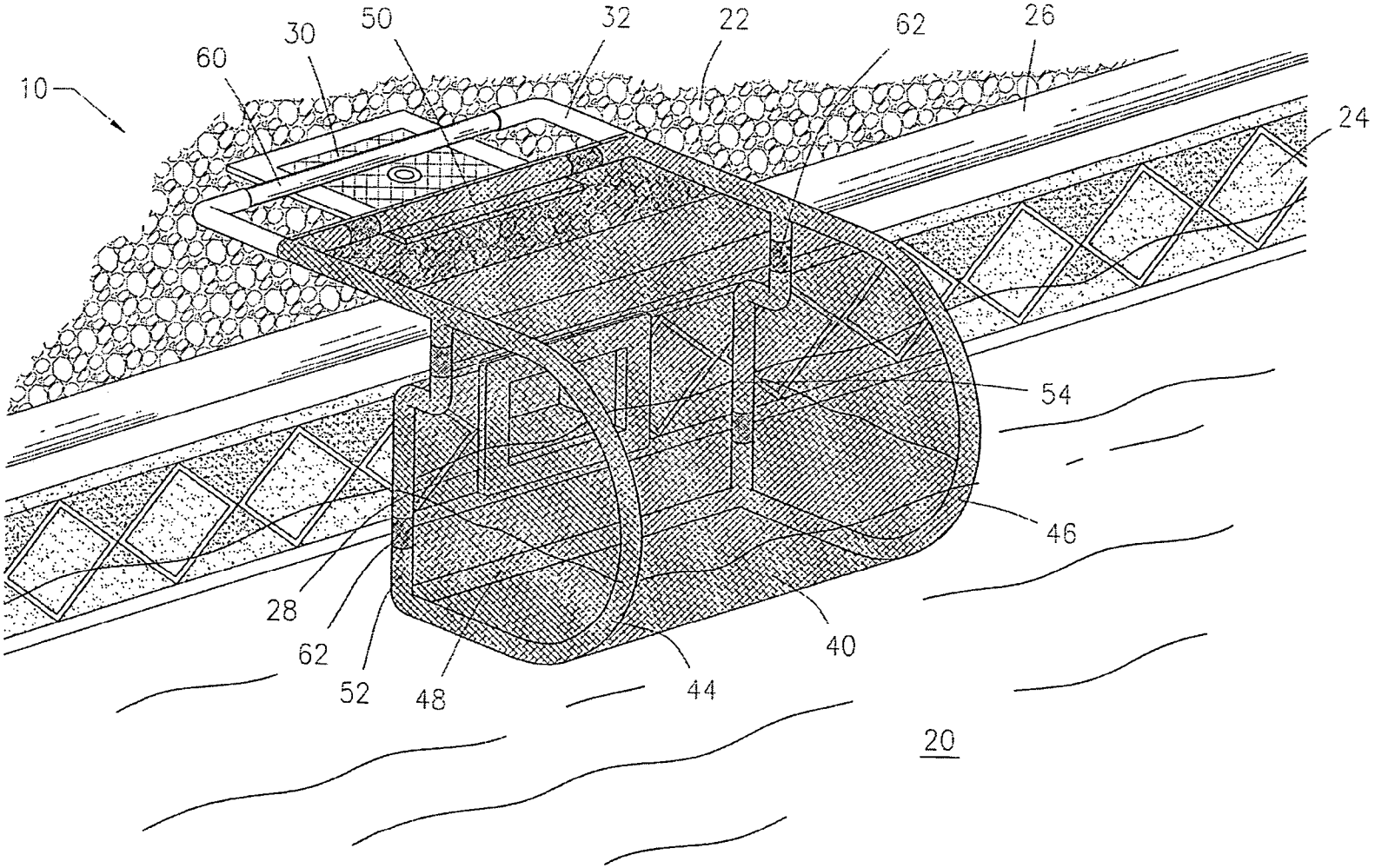
FIG. 1 is a perspective view of a portable skimmer, motor and pump protector constructed in accordance with the present invention installed on a swimming pool.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Referring to the drawings in detail, FIG. 1 illustrates a perspective view of a portable skimmer, motor and pump protector 10 installed for use on a swimming pool 20. Although the protector 10 is described in use with a swimming pool, it might also be employed with a hot tub or pond with a skimmer. The pool 20 includes a flat top deck 22 which extends away from the edge of the pool and may be composed of concrete, tile, bricks or various other materials. The top deck 22 adjoins and is substantially perpendicular to a sidewall 24 of the pool. Depending on the type of swimming pool, the sidewall may be composed of concrete, granite, fiberglass or a wall with a vinyl liner. The sidewall 24 extends both beneath and above the level of the water in the pool. Edging or coping 26 may be used at the intersection of the top deck and the sidewall.

The pool 20 also includes a skimmer assembly 28 having an opening through and recessed in the sidewall 24 of the pool.

The skimmer opening includes a portion both above and below the water level so that the skimmer assembly 28 will operate when the water is at various levels. In the present embodiment, the skimmer opening is rectangular; however, the protector 10 will operate with various skimmer configurations. The skimmer assembly 28 may also include a top opening 30 through the top deck to access a removable basket (not visible) which gathers leaves and other debris which is carried by the water into the skimmer assembly.

The protector 10 includes a frame 32 (to be described in detail) to support netting 40 which permits water from the pool 20 to easily pass therethrough. The netting 40 may have openings of various dimensions but will generally block leaves and other debris from passing through the netting. The netting 40 may be composed of nylon and substantially surrounds the skimmer 28 and its opening. Accordingly, the protector 10 in normal operation has a portion below the level of the water and a portion above the level of the water in the pool.

The protector 10 includes a frame 32 having a pair of semi-circular or arched portions 44 and 46 which are spaced from and parallel to each other. Other shapes are, of course, possible within the spirit and scope of the invention. The frame 32 also includes a brace portion 48 extending between the semi-circular portions 44 and 46.

The frame 32 also includes a top portion 50 which extends between the semi-circular portions 44 and 46 and rests on the top deck when in use. The brace portion 48 is parallel to the top portion 50.

The frame 32 also includes a pair of upright portions 52 and 54 which are spaced from and parallel to each other. When in use, the upright portions 52 and 54 rest against the sidewall 24 of the pool. Each of the upright portions 52 and 54 may include an offset to receive the edging or coping 26 that may extend outward from the sidewall of the pool 20.

The protector 10 may also include a handle 60 which extends from the top portions 50 of the frame 32. In one preferred embodiment, the handle 60 is composed of tubular metal so that it is weighted and assists in holding the protector in place.

The frame 32 may be constructed of lightweight material, such as fiberglass tubing or polyvinyl chloride (PVC) tubing in a single piece or in component pieces which are assembled in the field.

The frame 32 supports netting 40 which may be removably attached to the frame by hook and loop fastener straps 62, such as Velcro®.

The protector 10 acts as a cantilever which rests on the top deck to suspend the protector in front of the skimmer assembly opening.

Use of the present invention prevents the skimmer basket, the pump, and the filter from being clogged.

Whereas, the present invention has been described in relation to the drawings attached hereto, it should be understood that other and further modifications, apart from those shown or suggested herein, may be made within the spirit and scope of this invention.

What is claimed is:

1. A portable skimmer, motor and pump protector for a swimming pool or hot tub having a sidewall, an adjoining top deck, a skimmer in said sidewall in fluid communication with a pool pump, which protector comprises:

a frame having a top portion resting on said top deck, and an upright portion resting against said sidewall, wherein said frame surrounds said skimmer;

a handle extending from said frame top portion; and netting surrounding said frame to permit passage of water but prevent passage of leaves and other debris into said skimmer.

2. A portable skimmer, motor and pump protector as set forth in claim 1 wherein said handle is weighted.

3. A portable skimmer, motor and pump protector as set forth in claim 1 wherein said netting is removable from said frame.

4. A portable skimmer, motor and pump protector as set forth in claim 3 wherein said netting is attached to said frame by hook and loop straps.

5. A portable skimmer, motor and pump protector as set forth in claim 1 wherein said frame includes a pair of semi-circular portions and a brace portion extending between said semi-circular portions.

6. A portable skimmer, motor and pump protector as set forth in claim 1 wherein said frame is constructed from fiberglass tubes.

7. A portable skimmer, motor and pump protector as set forth in claim 1 wherein said frame is constructed from polyvinyl chloride tubes.

8. A portable skimmer, motor and pump protector for a swimming pool or a hot tub having a sidewall, adjoining top deck, a skimmer in said sidewall in fluid communication with a pool pump, which protector comprises:

a frame having a pair of semi-circular portions, a brace portion extending between said semi-circular portions, a top portion resting on said top deck, a pair of upright portions, each upright portion extending between each said semi-circular portion resting on said sidewall;

a handle extending from said frame top portion wherein said handle is weighted; and removable netting surrounding said frame to permit passage of water but prevent passage of leaves and other debris into said skimmer.

9. A portable skimmer, motor and pump protector as set forth in claim 8 wherein each said upright portion is partially offset to receive edging or coping.

10. A portable skimmer, motor and pump protector as set forth in claim 8 wherein said netting is attached to said frame by hook and loop straps.

11. A portable skimmer, motor and pump protector as set forth in claim 8 wherein said frame is constructed from fiberglass tubes.

12. A portable skimmer, motor and pump protector as set forth in claim 8 wherein said frame is constructed from polyvinyl chloride tubes.

13. A portable skimmer, motor and pump protector for a swimming pool or hot tub having a sidewall, an adjoining top deck, a skimmer in said sidewall in fluid communication with a pool pump, which protector comprises:

a frame having a top portion resting on said top deck, and an upright portion resting against said sidewall, wherein said frame surrounds said skimmer; and netting surrounding said frame to permit passage of water but prevent passage of leaves and other debris into said skimmer.

14. A portable skimmer, motor and pump protector as set forth in claim 13 wherein said frame further comprises a pair of semi-circular portions and a brace portion extending between said semi-circular portions, and where said upright portion resting against said sidewall is comprised of a pair of upright portions, each upright portion extending between each said semi-circular portion resting on said sidewall.

15. A portable skimmer, motor and pump protector as set forth in claim 13 said upright portion is partially offset to receive edging or coping.

16. A portable skimmer, motor and pump protector as set forth in claim 13 wherein said netting is attached to said frame by hook and loop straps.

17. A portable skimmer, motor and pump protector as set forth in claim 13 wherein said frame is constructed from fiberglass tubes.

18. A portable skimmer, motor and pump protector as set forth in claim 13 wherein said frame is constructed from polyvinyl chloride tubes.

* * * * *

UNITED STATES PATENT AND TRADEMARK OFFICE

CERTIFICATE OF CORRECTION

PATENT NO. : 7,594,997 B1
APPLICATION NO. : 11/934430
DATED : September 29, 2009
INVENTOR(S) : Kenneth B. Kazarian It is certified that error appears in the above-identified patent and that said Letters Patent is hereby corrected as shown below:

Title Page, item (73) Assignee: change "Wimax, LLC" to --Nimax, LLC--

Signed and Sealed this

First Day of December, 2009

David J. Kappos

David J. Kappos
*Director of the United States Patent and Trademark Office*